United States Patent [19]

Carmein et al.

[11] Patent Number: 4,945,725

[45] **Date of Patent: * Aug. 7, 1990**

[54] DIFFERENTIAL-AREA PISTON TYPE MIXED-PHASE MOTORS

[75] Inventors: David E. Carmein; Richard D. Hembree, both of Minneapolis, Minn.

[73] Assignee: Recovery Engineering, Inc., Minneapolis, Minn.

[ * ] Notice: The portion of the term of this patent subsequent to Dec. 27, 2006 has been disclaimed.

[21] Appl. No.: 237,774

[22] Filed: Aug. 29, 1988

Related U.S. Application Data

[63] Continuation-in-part of Ser. No. 062,177, Jun. 12, 1987, abandoned.

[51] Int. Cl.[5] ..... F01K 25/04; F25B 15/00

[52] U.S. Cl. ..... 60/509; 60/512; 60/649; 60/651; 60/673; 62/467; 62/476; 62/498

[58] Field of Search ..... 60/509, 512, 514, 651, 60/671, 649, 673; 62/87, 528, 467, 476, 498; 91/341 R, 416, 419, 436, 437, 533

[56] References Cited

U.S. PATENT DOCUMENTS

| | | | |
|---|---|---|---|
| 3,293,881 | 12/1966 | Walker | 62/476 |
| 4,068,476 | 1/1978 | Kelsey | 60/671 |
| 4,149,383 | 4/1979 | Spalding | 60/509 |
| 4,235,079 | 11/1980 | Masser | 62/87 |
| 4,391,571 | 7/1983 | Craggs | 91/436 X |
| 4,393,653 | 7/1983 | Fischer | 60/514 X |
| 4,759,189 | 6/1988 | Stropkay et al. | 60/527 X |
| 4,793,153 | 12/1988 | Hembree et al. | 62/476 |

FOREIGN PATENT DOCUMENTS

| | | |
|---|---|---|
| 0048139 | 3/1982 | European Pat. Off. . |
| 0146989 | 7/1985 | European Pat. Off. . |
| 0215659 | 3/1987 | European Pat. Off. . |
| 311254 | 2/1916 | Fed. Rep. of Germany . |
| 2211748 | 9/1973 | Fed. Rep. of Germany . |
| 2821462 | 11/1978 | Fed. Rep. of Germany . |
| 3133387 | 3/1983 | Fed. Rep. of Germany . |
| 3139478 | 4/1983 | Fed. Rep. of Germany . |
| 639373 | 6/1928 | France . |
| 697235 | 1/1931 | France . |
| 8600367 | 9/1987 | Netherlands . |
| 786519 | 11/1957 | United Kingdom . |
| 2086026 | 5/1982 | United Kingdom . |

*Primary Examiner*—Edward K. Look
*Assistant Examiner*—George Kapsalas
*Attorney, Agent, or Firm*—Merchant, Gould, Smith, Edell, Welter & Schmidt

[57] ABSTRACT

Motor apparatus which converts hydraulic energy and change of state heat energy to mechanical energy. The motor includes a main chamber divided by a piston into first and second portions. During a first half cycle or hydraulic power stroke, a valve places the first portion of the chamber in fluid communication with a source of pressurized, saturated liquid and the second portion of the chamber in fluid communication with a drain port. A switch senses the end of the hydraulic power stroke and causes the valve to move to a second position wherein the first and second portions of the chamber are placed in fluid communication with one another to form a common motor chamber and drive the piston in an expansion power stroke. Power is derived from the working fluid during the piston stroke in each direction. The motor finds particular application for energy recovery in an absorption refrigeration system.

12 Claims, 6 Drawing Sheets

DIFFERENTIAL-AREA PISTON TYPE MIXED-PHASE MOTORS

This application is a continuation-in-part of U.S. patent application Ser. No. 062,177 filed Jun. 12, 1987 now abandoned.

BACKGROUND OF THE INVENTION

1. Field of the Invention

The present invention is directed to energy recovery fluid motors and, more particularly, to a fluid motor wherein a high pressure, saturated or near saturated liquid changes phase during an expansion power stroke, which is after a hydraulic power stroke and before exhausting from the motor.

2. Description of the Prior Art

Various fluid circuits, especially refrigeration and/or heating systems, include segments where a higher pressure liquid is throttled through a valve to a lower pressure reservoir. In an absorption refrigeration system, for example, a higher pressure liquid passes through a control valve to a lower pressure evaporator. The evaporator absorbs heat from the environment thereby refrigerating the environment as desired. As the liquid is throttled through the valve, it at least partially changes phase. There is a loss not only of flow energy due to the pressure decrease through the valve, but also a loss of energy to the liquid when it changes phase from a liquid to a gas. The present invention is directed to convert some of the otherwise lost energy to mechanical energy.

SUMMARY OF THE INVENTION

The present invention is directed to a motor for powering a use device wherein the motor uses pressurized, saturated or near saturated liquid from a source as input and exhausts the fluid, when expended, to a drain. The motor includes a block and a driven member operably mounted with respect to the block. The motor also includes mechanism for driving the driven member. The driving mechanism includes mechanism for metering a discrete quantity of the liquid fluid from the source to drive the driven member through a hydraulic power stroke. The driving means further includes mechanism for expanding the quantity of metered liquid fluid wherein at least a portion of the liquid fluid changes phase to drive the driven member through an expansion power stroke. The motor has mechanism for controlling the driving mechanism, as well as mechanism for transferring to the use device energy from the driven member.

In another embodiment, the motor includes a casing defining a main chamber wherein a piston divides the main chamber into first and second portions. The motor also has mechanism for moving the piston through a hydraulic power stroke and an expansion power stroke. The moving mechanism includes a first mechanism for selectively placing the source of pressurized, saturated or near saturated liquid and the first portion of the main chamber in fluid communication with one another so as to move the piston through the hydraulic power stroke and for placing the second portion of the main chamber in fluid communication with the drain port. The moving mechanism further includes a second mechanism for selectively placing the first and second portions of the main chamber in fluid communication with one another and closing the main chamber to the source and the drain to allow the saturated liquid to at least partially expand and change phase in order to force the piston to move through the expansion power stroke. This embodiment of the motor also includes controlling mechanism for the first and second selectively placing mechanism and mechanism for transferring to the use device energy from the moving piston.

In still another embodiment, the first and second selectively placing mechanisms include a valve having first and second positions which accomplish the intended functions.

In yet a further embodiment, the energy transferring mechanism to a use device includes a second casing and a second piston connected by a main shaft to the first piston. This embodiment has further advantage in that equal power strokes are obtained during each half cycle. Therefore, energy is continuously converted and is provided to the use device in a relatively constant fashion.

The motor of the present invention receives pressurized, saturated or near saturated liquid through the valve to fill the first portion of the main chamber and hydraulically move the piston in a hydraulic power stroke while at the same time expelling spent liquid, now a liquid/vapor mixture. When the hydraulic power stroke is completed, the valve is shifted so that both the first and second portion of the main chamber are placed in fluid communication with one another to form a single motor chamber. The saturated or near saturated liquid expands and at least partially changes phase. Due to the different face areas on opposite sides of the piston because of the piston shaft, the expanding vapor/liquid forces the piston in an expansion power stroke, and, with mechanism such as a second shaft attached to the piston, energy is supplied to the use device. During the hydraulic power stroke, the spent liquid and vapor mixture is forced to drain from the second portion of the main chamber. In this way, in a system wherein fluid pressure is otherwise decreased and energy lost, generally through a valve, the present motor advantageously recovers energy and converts it to useful work.

The motor of the present invention is particularly advantageous since pressurized saturated or near saturated liquid is metered into the first portion of the main chamber while driving the piston in the chamber in one direction through a hydraulic power stroke. After the valve shifts to place the first and second portions of the main chamber in fluid communication with one another, fluid communication with the liquid source is stopped and, as a consequence, the main chamber is completely closed. In this configuration, the pressurized, saturated or near saturated liquid expands from the first portion into the second portion, and as it does so, changes phase and drives the piston in the other direction. On completion of the expansion power stroke, the valve again switches to begin a new hydraulic stroke. During the hydraulic power stroke, the spent liquid/vapor fluid exhausts to drain the second portion of the main chamber as a new quantity of pressurized, saturated or near saturated liquid is metered into the first portion. The present motor, thus, recovers not only work energy from the pressurized liquid, but also recovers heat energy inherent in the saturated or near saturated liquid as a result of the fluid phase change during expansion. Furthermore, the work and heat energy is recovered in a controlled fashion because the energy is recovered repetitively from discrete quantities of metered incompressible liquid which, as indicated, flow into and completely fill the first portion of the main chamber. During the first half cycle before the first and second portions of the main chamber are placed in fluid communication with one another which allows the discrete enclosed quantity of liquid to expand and change phase during the second half cycle. As an element of a system, the mixed-phase motor thus functions to control flow rate and pressure, while recovering energy.

Although the invention has been thusly summarized, preferred and other embodiments and the advantages of the invention are further described and explained and may be better understood by reference to the following drawings and the detailed descriptive matter thereafter.

DETAILED DESCRIPTION OF THE PREFERRED EMBODIMENTS

Figure 1:
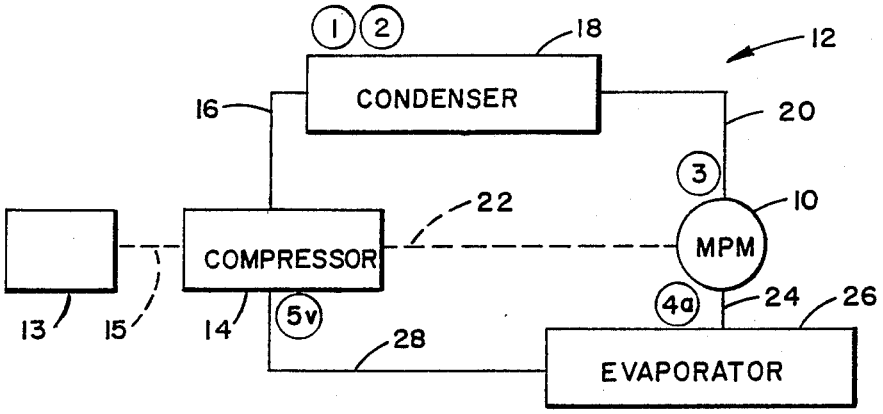
FIG. 1 is a schematic of a fluid system incorporating a mixed-phase motor in accordance with the present invention.

Referring now to the drawings wherein like reference numerals designate identical or corresponding parts throughout the several views, and more particularly to FIGS. 1 and 2, a motor in its simplest form of a type in accordance with the present invention is designated generally by the numeral 10 and is shown incorporated in a single working fluid system generally designated by the numeral 12. It is understood that the single working fluid system is exemplary and that the present invention is also applicable to use in other systems, particularly single effect and double effect absorption refrigeration systems.

System 12 shows a compressor 14 in fluid communication via line 16 with a condenser 18. Condenser 18 is in fluid communication via line 20 with mixed-phase motor 10. The broken line 22 illustrates that motor 10 at least partially drives compressor 14. In system 12, it is understood that additional motive power is needed as well to drive the compressor 14, as further indicated by auxiliary motor 13 and broken line 15. Fluid from motor 10 exhausts through line 24 to evaporator 26 and then again feeds compressor 14 via line 28. It is noted that an auxiliary motor may not be needed in some fluid systems in which a mixed-phase motor may be used, for example, an absorption refrigeration system.

System 12 yields heat to the environment at condenser 18 and provides a liquid saturated or close to saturation as its output. The liquid is at a high pressure as a result of the work accomplished by compressor 14. A mixed-phase motor 10 reduces the pressure while at the same time recovers energy which is used to partially drive compressor 14. The fluid exhausted by motor 10 is partially a liquid and partially a vapor. Evaporator 26 absorbs heat and provides a vapor as an output. Thus, as a part of system 12, mixed-phase motor 10 of the present invention receives a high pressure, saturated liquid and converts energy therein to exhaust a lower pressure fluid in partially liquid and vaporous states.

Figure 2A:
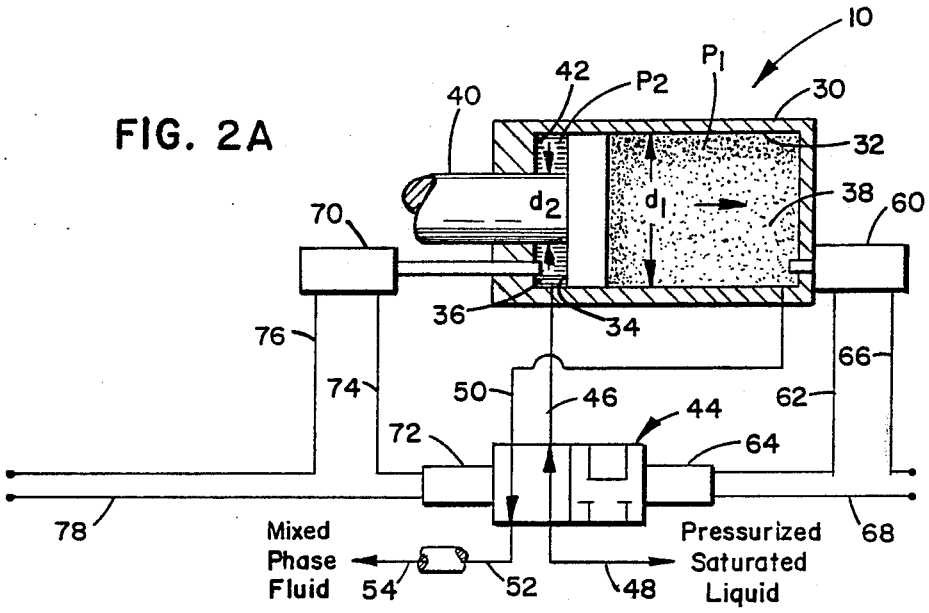
FIGS. 2A and 2B illustrate the hydraulic power stroke and the expansion power stroke configurations of a single chamber motor in accordance with the present invention, respectively.
Figure 2B:
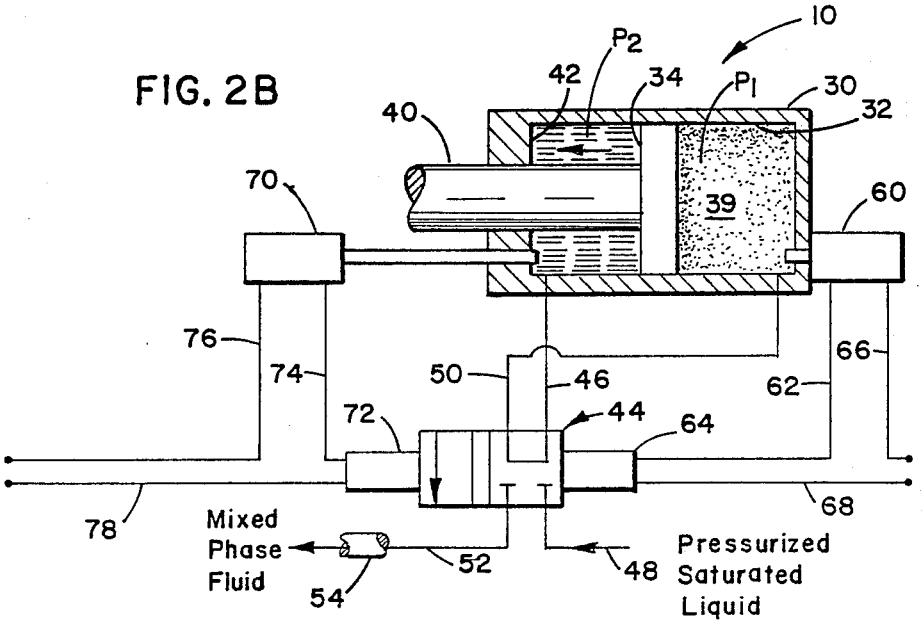

As shown in FIGS. 2A and 2B, motor 10 includes a block in the form of casing 30 which includes a main chamber 32. In FIG. 2A, a piston 34 divides main chamber 32 into a first portion or charging chamber 36 and a second portion or exhaust chamber 38. It is understood that piston 34 is representative of driven members and that other such mechanisms, such as a diaphragm, are equivalent. It is noted that the hydraulic power stroke of motor 10 occurs while piston 34 is moving to increase the size or volume of the first portion 36 of chamber 32. The expansion power stroke occurs while piston 34 is moving in a direction opposite to the direction of the hydraulic power stroke. A shaft 40 is connected to piston 34 and extends through the first portion 36 of chamber 32 and a wall 42 of casing 30. It is understood that shaft 40 is attached to appropriate mechanism for mechanically driving a use device (not shown). It is further understood that seals and other such mechanisms are used on piston 34 and shaft 40 as known to those skilled in the art. Main chamber 32 is preferably cylindrical with a diameter $d_1$. Piston 34 with appropriate seals has a similar diameter. Shaft 40 has a diameter of $d_2$.

Motor 10 also includes a four-way, two position valve 44. In the hydraulic power stroke configuration shown in FIG. 2A, valve 44 is in a first position wherein the first portion 36 of chamber 32 is in fluid communication via line 46, valve 44, and line 48 with a source of pressurized, saturated or near saturated liquid. The hydraulic flow of the liquid moves piston 34 in the hydraulic power stroke thereby metering into first portion 36 a discrete quantity of liquid. The second portion 38 of chamber 32 is in fluid communication via line 50, valve 44, and line 52 with a drain port 54. Spent mixture is exhausted through drain port 54. It is understood that drain port 54 may actually be a part of valve 44. It is also understood that line 48 and drain port 54 may connect with additional fluid circuitry of a typical type as shown in FIG. 1.

In the expansion power stroke configuration as shown in FIG. 2B, valve 44 is in a second position wherein the first and second portions 36 and 38 of main chamber 32 are in fluid communication with one another via lines 50 and 46 through valve 44. Thus connected, the first and second portions form one motor chamber 39 which is completely closed from the source and from the drain.

As soon as motor chamber 39 is formed, the liquid in first portion 36 expands into second portion 38 and partially vaporizes. The pressure of the liquid/vapor mixture forming on the non-shaft side of motor chamber 39 is equal to the pressure on the shaft side, but acts against the entire face of piston 34 in opposition to the liquid pressure on the shaft side of the piston having a face area minus the shaft area. Because the area on the non-shaft side is so much greater than on the shaft side, the force exerted by the liquid/vapor mixture is overpowering compared to the force exerted by the liquid on the shaft side. Hence, piston 34 is moved by the liquid/vapor mixture through the expansion power stroke.

Valve 44 and piston 34 cooperate closely with one another so that the ends of the strokes cause valve switching, and when valve 44 switches, piston 34 changes direction. As shown in FIG. 2A, a limit switch 60 senses piston 34 at the end of the hydraulic power stroke and communicates electrically via line 62 with the solenoid 64 of valve 44 which causes valve 44 to switch. Switch 60 and solenoid 64 are in electrical communication with an electrical source via lines 66 and 68.

Likewise, a limit switch 70 senses piston 34 at the end of the expansion power stroke. Switch 70 is in electrical communication with solenoid 72 of valve 44 via line 74. Switch 70 and solenoid 72 are in electrical communication with a source via lines 76 and 78.

It is understood that limit switches 60 and 70 can take a variety of forms. They may sense, for example, motion based on mechanical, electrical, magnetic, hydraulic or other physical principles. In like fashion, they may communicate with valve 44 via a signal that is mechanical, electrical, magnetic, hydraulic or a signal of some other physical type. The important consideration is that the end motion of piston 34 must be sensed in both directions and that a signal is sent to control valve 44.

Figure 3A:
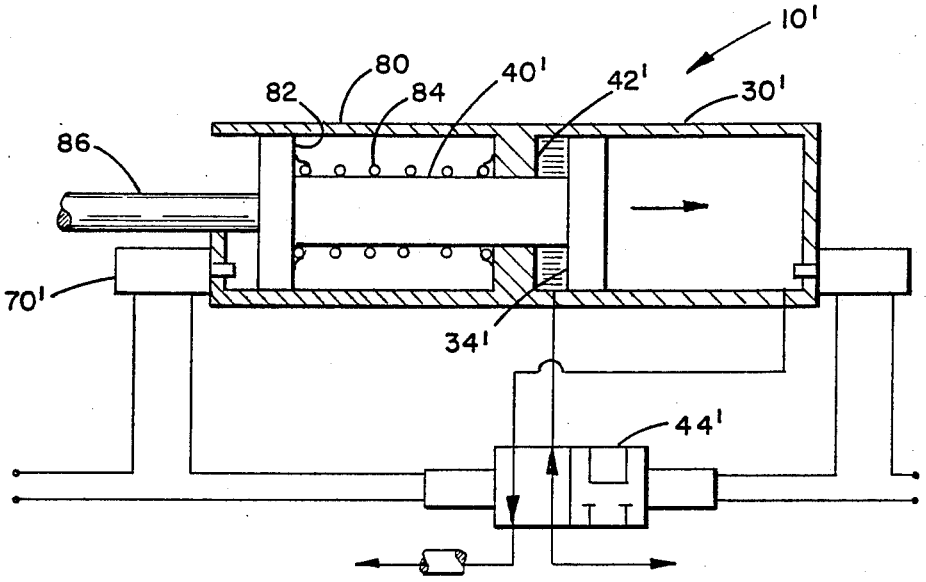
FIGS. 3A and 3B illustrate a motor similar to FIGS. 2A and 2B with a force mechanism for increasing piston movement during the hydraulic power stroke.
Figure 3B:
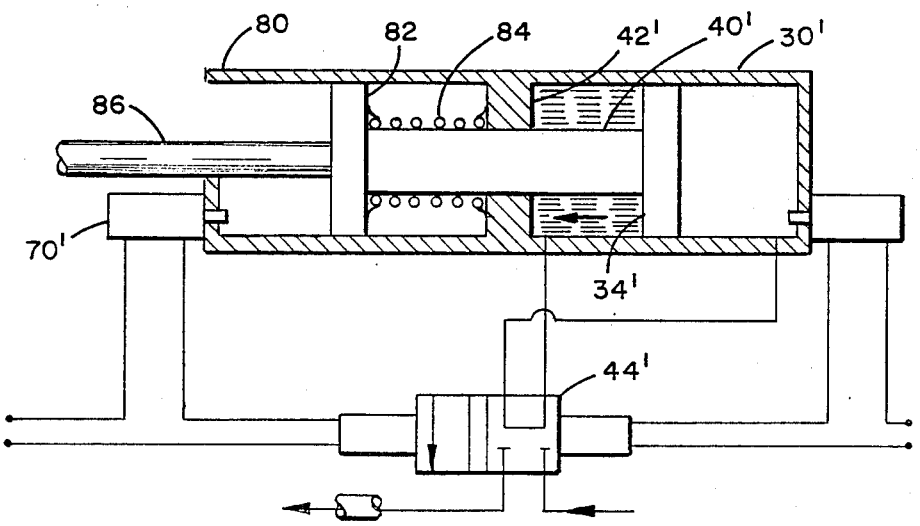

In an alternate embodiment of the present invention as shown in of FIGS. 3A and 3B and throughout the remainder of the specification, identical or corresponding parts of alternate embodiments are designated by the same numeral as the first embodiment, only with a higher number of prime markings. Except for structure relating to the provision of an auxiliary force acting to help drive piston 34' in the expansion power stroke, motor 10' is the same as motor 10. In this regard casing 30' includes a guide wall 80 for a guide member 82. Guide member 82 is attached to the end of shaft 40 opposite piston 34'. A spring 84 provides appropriate force. Spring 84 functions in tension between wall 42' and guide member 82. Since guide member 82 is physically connected with piston 34', limit switch 70' can sense the travel of guide member 82 rather than the travel of piston 34' and still provide the appropriate switching control for valve 44'. A shaft 86 is attached to guide member 82 and provides a mechanism for energy transfer to a use device. Although shaft 86 is shown connected to piston 34' through shaft 40' and guide member 82, it is understood that shaft 86 could as well be connected to the side of piston 34' opposite shaft 40' and extend through the wall of casing 30' to connect with a use device.

Figure 4A:
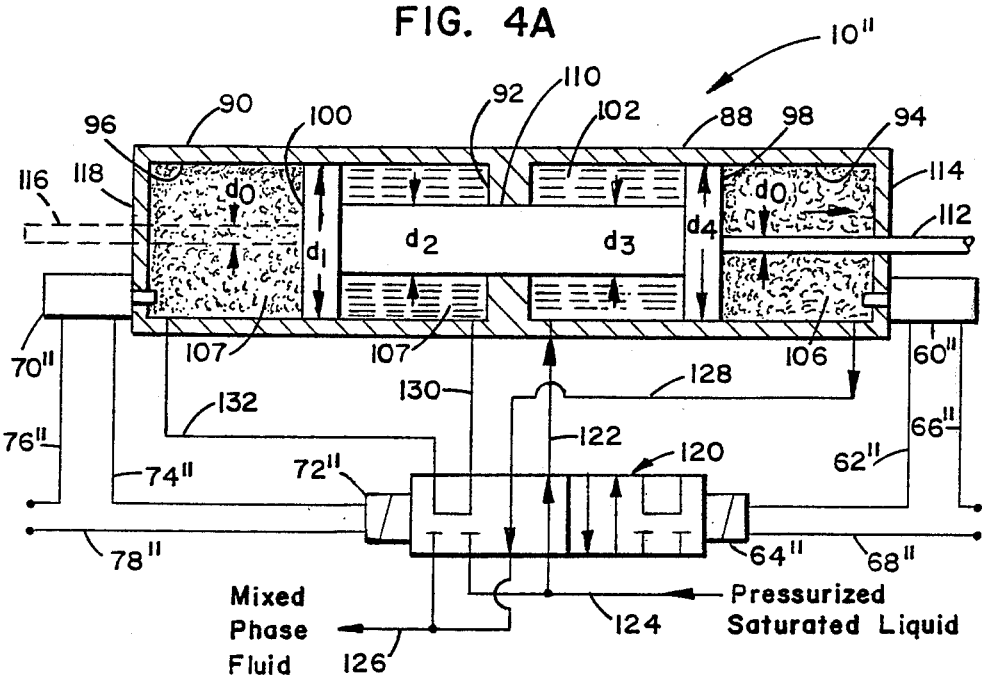
FIGS. 4A and 4B illustrate both half cycle configurations of a dual chamber motor in accordance with the present invention.
Figure 4B:
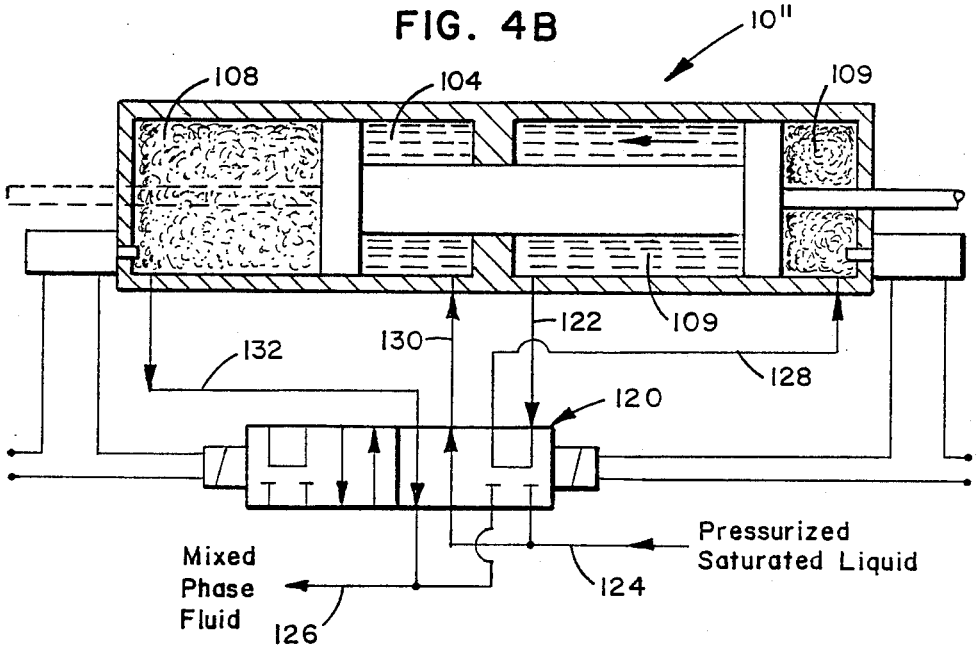

The preferred embodiment, motor 10'', is shown in FIGS. 4A and 4B. Motor 10'' is dual cylinder and provides equal energy conversion during each half cycle. Motor 10'' includes first and second casings 88 and 90 with typically a common wall 92 separating first and second main chambers 94 and 96, respectively. First and second pistons 98 and 100 divide first and second main chambers 94 and 96 into first portions 102 and 104 and second portions 106 and 108, respectively. A main shaft 110 has opposite ends which attach to first and second pistons 98 and 100. Main shaft 110 extends through common wall 92 of first and second casings 88 and 90. A drive shaft 112 attaches to piston 98 and extends through a wall 114 of first casing 88. Wall 114 is generally opposite from common wall 92. It is understood that drive shaft 112 could as well be attached to piston 100 instead of piston 98 thereby extending in the opposite direction as shown. Although not necessary, it is preferable that a dummy shaft 116 be attached to the opposite piston as shaft 112 is attached, in this case to piston 100. Dummy shaft 116 has a diameter $d_0$ the same as drive shaft 112 and thus, at equivalent locations of the pistons, dummy shaft 116 and drive shaft 112 reduce the volume of the respective chambers equally. Dummy shaft 116 can either extend through wall 118 opposite common wall 92 or telescope into piston 100 and main shaft 110. Since at least some of the working liquid changes phase to a vapor, the presence of a dummy shaft 116, although important as indicated, is not necessary. If dummy shaft 116 were not present, the gaseous component of the working fluid would pressurize or depressurize somewhat more or less depending on the situation than would be the case for complete symmetry. It is also understood that the various shafts and pistons include appropriate sealing mechanisms of a type known to those skilled in the art. It is further understood that although shaft 110 is shown as a linear element, that an equivalent structure need not be linear. Similarly, the cylindrical configuration of the pistons, shafts and chambers could as well take some other form.

Motor 10'' includes an eight way, two position valve 120. Valve 120 has a first position, as shown in FIG. 4A, placing first portion 102 of first main chamber 94 in fluid communication with a source of pressurized saturated liquid via line 122 through valve 120 and line 124 and placing second portion 106 of first main chamber 94 in fluid communication with a drain line 126 through valve 120 via line 128. At the same time, first and second portions 104 and 108 of second main chamber 96 (see FIG. 4B) are placed in fluid communication with one another through valve 120 via lines 130 and 132 to form motor chamber 107. As shown in FIG. 4B, each half of motor 10'' exchanges configurations with the other during the other half cycle of operation. That is, first portion 104 of second main chamber 96 is placed in fluid communication with the source of pressurized saturated liquid via line 130, valve 120 and line 124. Second portion 108 of second main chamber 96 is placed in fluid communication with drain line 126 through line 132 and valve 120. And first and second portions of first main chamber 94 are placed in fluid communication with one another through valve 120 via lines 122 and 128 to form motor chamber 109.

Just as with embodiment motor 10 shown in FIGS. 2A and 2B, motor 10'' includes limit switches 60'' and 70'' in electrical communication via lines 62'' and 74'' with solenoids 64'' and 72'', respectively. The switches and solenoids are also wired to a source in a similar fashion via lines 66'' and 68'' for the one set and lines 76'' and 78'' for the other. Limit switch 60'' senses the end of the hydraulic power stroke of piston 98, which is also the end of the expansion power stroke of piston 100, while limit switch 70'' senses the end of the hydraulic power stroke of piston 100, which is the end of the expansion power stroke of piston 98. In this regard, it is noted that it is preferable for the pistons of each of the various embodiments to travel to very near the end walls of the various chambers thereby substantially emptying a particular chamber during a particular stroke.

SYSTEM OPERATION

A motor, or heat engine, withdraws energy from a high temperature source, does work, and rejects the remainder of the energy to a low temperature sink. A heat pump operates in reverse. It extracts energy from a low temperature source, adds work, and rejects the work energy plus low temperature energy to a high temperature sink. The amount of work available or required in either case is limited by the first and second laws of thermodynamics.

A mixed-phase motor in accordance with the present invention extracts both flow work and expansion work from a high pressure, high temperature, saturated or slightly subcooled liquid. In the process pressure and temperature are reduced, and the extracted energy is returned as linear shaft work. As indicated hereinbefore, a mixed-phase motor as a result can be substituted for a fluid control valve so as to return as shaft work some of the energy otherwise lost through the valve. Shaft work can be linked to any of several useful devices, such as a piston pump, a compressor, etc.

The term "high" is understood to be relative to a related lower pressure or temperature. A "saturated" liquid will begin to form vapor if any additional heat is added at a constant pressure. A "subcooled" or near saturated liquid will take some quantity of heat, rising in temperature before beginning to form vapor, at which point the liquid becomes saturated and then begins to form vapor.

Figure 7:
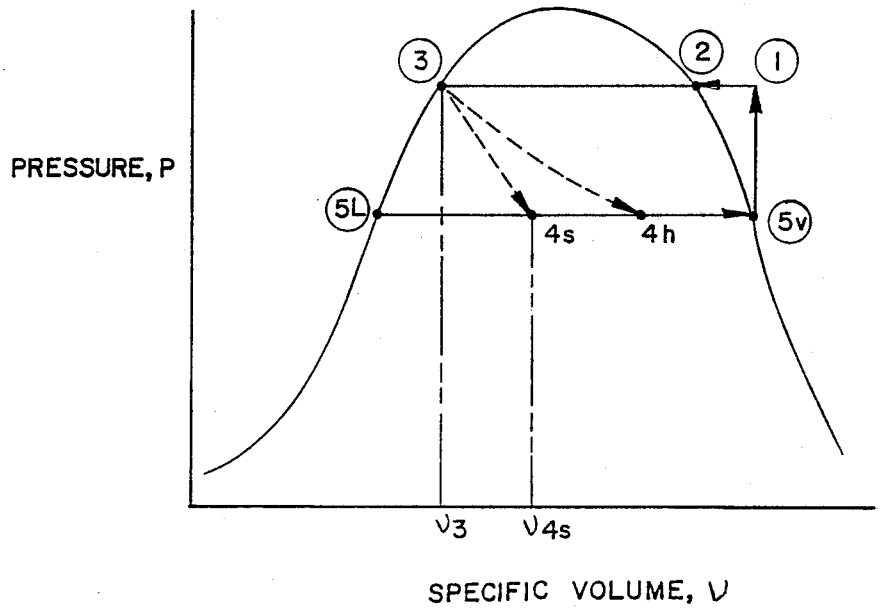
FIG. 7 illustrates a typical pressure versus specific volume phase diagram.
Figure 5:
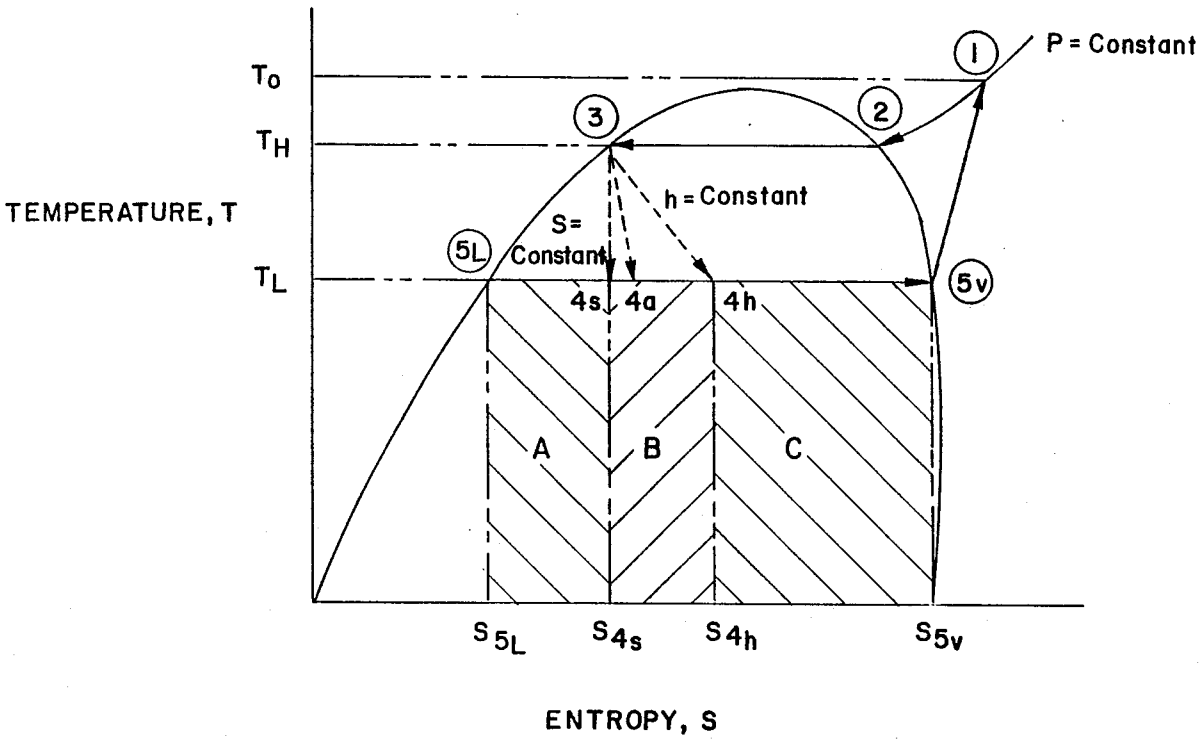
FIG. 5 illustrates a typical temperature versus entropy phase diagram.
Figure 6:
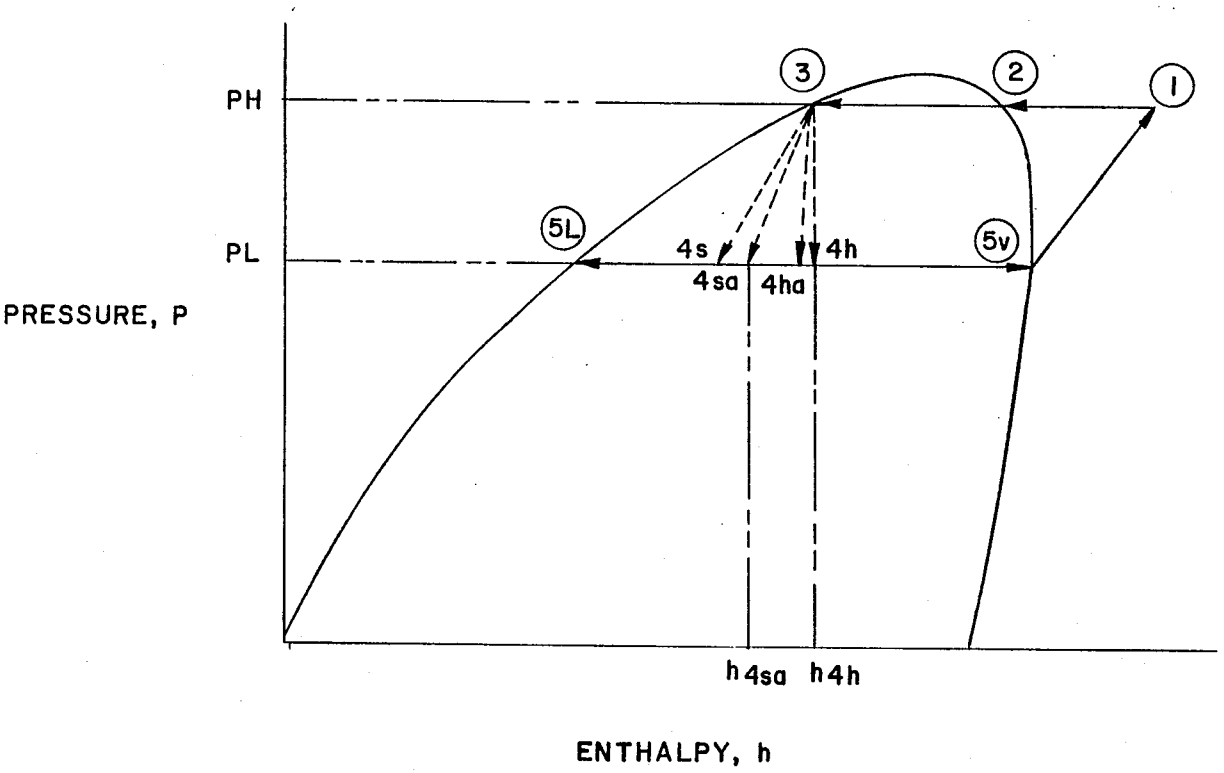
FIG. 6 illustrates a typical pressure versus entalpy phase diagram.

A mixed-phase motor and a typical system in which it can advantageously function, as shown in FIG. 1, is better understood with reference to typical thermodynamic phase diagrams as shown in FIGS. 5–7. FIG. 5 shows a graph of temperature versus entropy. Entropy is a measure of the orderliness of a substance. FIG. 6 shows a graph of pressure versus enthalpy which is a measure of the energy of a substance contained in both its pressure and temperature. Entropy and enthalpy typically have meaning when they are used to compare two states. Typically, the final enthalpy of a substance is subtracted from its initial entalpy to give a measure of whether heat or work has been added or subtracted. Likewise, the initial and final entropies of a substance may be compared as a measure of how effectively the potential to do work has been employed.

An ideal valve is a constant enthalpy, or isenthalpic, device. The enthalpy of a substance on the high pressure side of the valve is the same as the enthalpy of the substance on the low pressure side in the case of an ideal valve. An ideal motor is a constant entropy, or isentropic device. A motor which expands a substance isentropically while extracting work (as in the case of a piston enlarging a chamber conveying force to a crank) is extracting the most amount of work theoretically available in that substance. An ideal mixed-phase motor (if that were possible), would extract work isentropically where there likely once was an isenthalpic valve.

FIG. 5 shows the thermodynamic cycle for a refrigerant with respect to the system of FIG. 1. FIG. 5 is shown in terms of temperature (T) versus entropy (S). Points 1 through 5V in FIG. 1 correspond to the T-S states of points 1–5V in FIG. 5. At point 1, T and S are high. The vapor is somewhat "superheated", meaning that heat removal lowers the temperature of the vapor slightly before it begins to condense and form liquid. Point 2 represents where the vapor begins to condense. Condensation at constant pressure is an isothermal process which is represented by the straight horizontal line between points 2 and 3. Fully condensed refrigerant then passes through mixed-phase motor 10. If an ideal valve were used in the system instead of mixed-phase motor 10, the state of the refrigerant after passing through such valve would be 4*h*. Point 4*s* shows the state of the refrigerant after passing through a perfect mixed-phase motor. Complete evaporation with an evaporator leads to point 5V. Assuming a single working fluid, like water, the vapor is then compressed back to point 1 from point 5*v*.

Many thermodynamic charts of property X versus property Y have a characteristic dome. FIGS. 5–7 show such a dome. The state of a substance can be conclusively determined by considering a horizontal line which starts at the left vertical margin of one of the charts, passes through the dome, and continues toward the right out of the dome. States along the line to the left of the dome are subcooled liquid. The point where the line contacts the left side of the dome is the point where vapor is just about to form. As the line proceeds through the dome, more and more vapor is generated until the right side of the dome is reached. At that point, all the substance is vapor. From that point to the right, the substance is all superheated vapor.

If a dome is drawn correctly, the mass percentage of vapor and liquid for the mixture represented by points within the dome can be calculated. Looking at FIG. 5, for example, point 5L is all liquid at temperature $T_L$ and entropy $S_{5L}$. Point 5V is all vapor. Point $4_S$ represents a vapor/liquid mixture wherein after passing through a mixed phase motor, the quality, X, of the mixture can be expressed as a mass percentage of vapor in the vapor/-liquid mixture by the following relationship:

$$X = \frac{S_{4s} - S_{5L}}{S_{5v} - S_{5L}}$$

On reviewing this relationship, it is apparent from FIG. 5 that an isentropic expansion through a valve leading to point $4_h$ would yield more vapor than is the case for fluid expansion through a mixed-phase motor. Intuitively, it is reasonable to expect that energy wasted producing vapor on passing through a valve is harnessed by a mixed-phase motor as useful work.

It is understood, of course, that real world conditions result in inefficiencies. Even the best designed mixed-phase motor will increase the entropy of the refrigerant. Consequently, point $4_a$ is the actual entropy of the fluid which leaves a mixed-phase motor.

Isothermal processes can use the formula Q=T x d(S). That is, the quantity of heat transferred is equal to the temperature of the process times the entropy change. In the evaporator, the entropy change is the difference between a mixture in one of states 4 and state 5V, where all the fluid has been vaporized. Area C then is equal to $T(S_{5V}-S_{4h})$ for an isentropic valve. Area C represents "no cost" energy transferred into the system of FIG. 1 from the environment. Area B represents the additional energy which would be transferred into the system due to the use of a mixed-phase motor. In other words, a mixed-phase motor extracts work, resulting in a downstream mixture that has more liquid and less vapor. Therefore, more heat is drawn by the evaporator of the refrigeration system in order to evaporate the additional liquid. That amount of additional heat energy is equal to area B (in an ideal device).

The amount of work available to the mixed-phase motor may be determined from FIG. 6, a pressure versus enthalpy diagram. Expansion of refrigerant through an isentropic valve results in state $4_h$. In reality, the enthalpy will decrease slightly as it passes through the valve, resulting in state $4_{ha}$. State $4_s$ is the enthalpy state at pressure $P_L$ for refrigerant passing through an isentropic mixed-phase motor. State $4_{sa}$ is for a less than ideal mixed-phase motor.

The theoretic maximum amount of work a mixed-phase motor can produce per pound of refrigerant passing through is equal to the difference between the enthalpy at state 3 and at state $4_s$. The power produced is the enthalpy difference times the mass flow rate. For a real device, available power is as follows:

$$\text{Power}=(h_{4h}-h_{4sa})\times M$$

Knowing the available energy, it is then possible to determine whether the mixed-phase motor can produce sufficient power for the particular application or whether it needs to be assisted by an additional standard motor.

A pressure versus specific volume chart is shown in FIG. 7. By knowing the specific volume of refrigerant at states 3 and 4, an appropriate design for a mixed-phase motor can be determined. In this regard, the temperature, and therefore the pressure of refrigerant condensing or evaporating between points 2 and 3 and between points 4 and 5 is set by the temperature of the appropriate heat sink or heat source. The range of temperatures expected during a fluid cycle is ordinarily known to a designer. When a design temperature is selected, the specific volume for the vapor/liquid mixture exhausting from the mixed-phase motor becomes fixed at point V4s. The temperature and pressure of the fluid exiting the condenser fixes the specific volume of fluid entering the mixed phase motor at point V3.

In the most general case, the necessary dimensions for a mixed-phase motor are shown in FIG. 4B. Since motor 10'' is a reciprocating device, it must have symmetry. That is, for the two sides to operate with 180 degree phase shift, they must be dimensionally identical. Since work is drawn off through a shaft and since that shaft occupies volume associated with main chamber 106, a "dummy shaft" 116 of identical diameter is provided for main chamber 108. As indicated hereinbefore, the dummy shaft may extend out of the device, as shown, where it might be attached to another use device, or it may extend into the device in a telescoping fashion (not shown). In any case, due to symmetry, $d_1$ equals $d_2$ and $d_3$. Shafts 112 and 116 have diameters of $d_0$. By considering the volume of the refrigerant solution at the end of each stroke, the following relationship is developed:

$$\frac{d_1^2 - d_2^2}{d_1^2 - d_0^2} = \frac{v_3}{v_{4s}}$$

Where $v_3$ is a specific volume of liquid entering the mixed-phase motor and $v_{4s}$ is a specific volume of liquid/vapor mixture exiting the mixed-phase motor, and the diameters are as defined with respect to FIG. 4B considering the symmetries indicated hereinbefore. In addition, it is noted that the relationship is also appropriate for motors 10 and 10' where $d_0$ is zero.

With respect to all of the embodiments, it is noted that the length of piston stroke is a matter of engineering design and can be selected as desired. It is also noted that many liquid solutions may be used as working fluids.

With respect to the particular operation of motor 10, assuming the pressure ratio and diameter ratio of the chamber size to the shaft size satisfies the relationship discussed hereinbefore, piston 34 will travel through a hydraulic power stroke when valve 44 is in its first position. When valve 44 is in its first position, pressurized liquid flows in a metered fashion to the first portion 36 of chamber 32 and hydraulically forces piston 34 thereby also exhausting liquid and vapor from the second portion 38 of chamber 32 to drain port 54. Piston 34 travels until it is sensed by switch 60. At that point, solenoid 64 causes valve 44 to move to its second position. First and second portions 36 and 38 are then placed in fluid communication with one another through valve 44 to form motor chamber 39. The saturated liquid expands and forces piston 34 through an expansion power stroke. When piston 34 is sensed by switch 70, solenoid 72 causes valve 44 to move again to its first position to repeat the motor cycle. The reciprocating motion is transferred as mechanical energy to a use device through shaft 40.

Motor 10' functions similarly except spring 84 pulls in tension against guide 82 during the expansion power stroke when valve 44' has moved to its second position. Also, it is noted that switch 70' may sense the end of the power stroke by sensing guide 82 instead of piston 34'.

Motor 12'' functions similarly except it has dual elements so that one side of the motor is always in a hydraulic power stroke and the other is in an expansion power stroke. That is, when valve 120 is in a first position, pressurized, saturated liquid flows to first portion 102 of first main chamber 94 and moves piston 98 in a hydraulic power stroke. Liquid and vaporized fluid exhausts from second portion 106 to a drain line 126. The other side of motor 10'' has first and second portions 104 and 108 of second main chamber 96 in fluid communication with one another through valve 120 to form motor chamber 107, and piston 100 moves in an expansion power stroke. Thus, since piston 98 is connected with piston 100 by shaft 110, piston 98 is moved in a hydraulic power stroke as piston 98 moves through its expansion power stroke. When switch 60'' senses piston 98, valve 120 is moved by the action of solenoid 64'' to its second position. Pressurized, saturated liquid, now in fluid communication with first portion 104, forces piston 100 in a hydraulic power stroke. Liquid and vapor fluid mixture is exhausted to drain line 126 through valve 120. First and second portions 102 and 106 are in fluid communication with one another through valve 120 forming a single motor chamber 109. As piston 98 moves through its expansion power stroke, piston 100 is moved through its hydraulic power stroke. When switch 70'' senses piston 100 at the end of its expansion power stroke, solenoid 72'' functions to move valve 120 back to its first position so that the motor continues to cycle. Reciprocating mechanical energy is transferred to a use device with drive shaft 112 which is attached to piston 98. Energy may also be delivered to a use device with dummy shaft 116 attached to piston 100. Usually, however, dummy shaft 116 simply functions to reduce the volume exhaust chamber 1208 in a fashion similar to the volume reduction of exhaust chamber 108 as a result of shaft 112.

Thus, the mixed-phase motor of the present invention has been described in the form of various embodiments. Furthermore, the function of the motor has been related to the thermodynamics of a typical working fluid. It is understood, however, that the mixed-phase motor is conceptual and that numerous equivalents are possible. Consequently, any changes made from the disclosure as presented, especially in matters of design, shape, size and arrangement of parts to the full extent extended by the general meaning of the terms in which the appended claims are expressed, are within the principle of the invention.

What is claimed is:

1. A motor for powering a use device, said motor using pressurized, saturated or near saturated liquid fluid from a source as input and exhausting said fluid when expended to a drain, said motor comprising:

a block;

a driven member operably mounted with respect to said block;

means for driving said driven member, said driving means including means for metering a discrete quantity of said liquid fluid from said source to drive said driven member in a first direction through a hydraulic power stoke, said driving means further including means for expanding said quantity of said metered liquid fluid wherein at least a portion of said liquid fluid changes phase to drive said driven member in a second direction opposite to the first direction through an expansion power stroke;

means for controlling said driving means; and means for transferring to said use device energy from said driven member.

2. The motor in accordance with claim 1 wherein said block includes a casing defining a main chamber, said driven member includes a piston dividing said main chamber into first and second portions, said driving means includes a valve, said metering means includes first fluid communication means in combination with said valve and said controlling means which allows said pressurized, saturated or near saturated liquid fluid to flow from said source through said first fluid communication means and said valve to said first portion of said main chamber to hydraulically drive said piston, and said expanding means includes second fluid communication means in combination with said valve and said controlling means which allows said liquid fluid metered by said metering means to expand from said first portion of said main chamber to said second portion such that said liquid fluid at least partially changes phase and due to expansion drives said piston.

3. A motor for powering a use device, said motor using pressurized, saturated or near-saturated liquid fluid from a source as input and exhausting said fluid when expended to a drain, said motor comprising:

a casing defining a main chamber;

a piston dividing said main chamber into first and second portions;

means for moving said piston through a hydraulic power stroke and an expansion power stroke, said moving means including first means for selectively placing said source and said first portion of said main chamber in fluid communication with one another to move said piston through the hydraulic power stroke and placing said second portion of said main chamber in fluid communication with said drain port, said moving means further including second means for selectively placing said first and second portions of said main chamber in fluid communication with one another and closing said main chamber to said source and said drain to allow said saturated liquid to at least partially expand and change phase forcing said piston to move through the expansion power stroke;

means for controlling said first and second selectively placing means; and means for transferring to said use device energy from said moving piston.

4. The motor in accordance with claim 3 wherein said moving means further includes means external of said casing for forcing said piston in a direction increasing the size of said first portion of said main chamber thereby aiding said piston to move through the hydraulic power stroke.

5. The motor in accordance with claim 4 wherein said casing is a first casing, said main chamber is a first main chamber, said piston is a first piston, and wherein said forcing means includes:

a second casing defining a second main chamber;

a second piston dividing said second main chamber into third and fourth portions:

a main shaft extending through said first and second casings and attaching at opposite ends to said first and second pistons;

third means for selectively placing said fourth portion of said second main chamber in fluid communication with said drain port and placing said source and said third portion of said second main chamber in fluid communication with one another to move said second piston through a hydraulic power stroke;

fourth means for selectively placing said third and fourth portions of said second main chamber in fluid communication with one another and closing said second main chamber to said source and to said drain thereby allowing said liquid to at least partially change phase and move said second piston through an expansion power stroke, said main shaft moving simultaneously during the expansion power stroke of said first piston and the hydraulic power stroke of said second piston and vice versa; and second means for controlling said third and fourth placing means;

wherein said second piston is in a hydraulic power stroke when said first piston is an expansion power stoke and vice versa, said main shaft connecting said first and second pistons together to function cooperatively to provide through said transferring means full cycle power to said use device.

6. The motor in accordance with claim 5 wherein said first, second, third, and fourth selectively placing means include an eight way, two position valve, said first and fourth placing means including said valve in said first position, said second and third placing means including said valve in said second position.

7. The motor in accordance with claim 5 wherein said transferring means includes a drive shaft attached to one of said first and second pistons and extending through said corresponding one of said first and second casings to connect with said use device.

8. The motor in accordance with claim 3 wherein said first and second placing means includes a valve having first and second positions, said first placing means including said valve in said first position, said second placing means including said valve in said second position.

9. The motor in accordance with claim 3 wherein said transferring means includes a shaft connected to said piston and to said use device.

10. A motor for converting energy associated with change of phase of a fluid, said energy for powering a use device, said motor comprising:

first and second casings defining first and second main chambers, respectively;

first and second pistons dividing said first and second main chambers into first and second portions and third and fourth portions, respectively, a main shaft having opposite ends, said main shaft extending through said first and second casings and attaching at said first and second opposite ends to said first and second pistons, respectively;

a drive shaft attached to one of said first and second pistons, said drive shaft extending through a corresponding one of said first and second casings which contains said one piston to which said drive shaft is attached;

a fluid drain line;

a source of pressurized, saturated or near saturated liquid; and an eight way, two position valve, said valve having a first position placing said source and said first portion of said first main chamber in fluid communication with one another and placing said second portion of said first main chamber and said fluid drain line in fluid communication with one another and placing said third and fourth portions of said second main chamber in fluid communication with one another to close said second main chamber to said source and said drain line, said valve having a second position placing said first and second portions of said first main chamber in fluid communication with one another to close said first main chamber to said source and said drain line and placing said source and said third portion of said second main chamber in fluid communication with one another and placing said fourth portion of said second main chamber and said fluid drain line in fluid communication with one another;

wherein said first piston in a first hydraulic power stroke and said second piston in a first expansion power stroke in a first half cycle combine to drive said use device and said first piston in a second hydraulic power stoke and said second piston in a second expansion stroke in a second half cycle combine to drive said use device, said controlling means moving said valve between said first and second positions.

11. The motor in accordance with claim 10 including a dummy shaft attached to the other of said first and second pistons as said drive shaft and extending to a wall of a corresponding one of said first and second casings, said drive shaft and said dummy shaft having identical cross-sectional dimensions.

12. A method for using a motor to convert energy from a pressurized, saturated or near saturated liquid to mechanical energy, said motor including a main chamber with first and second portions and means for reciprocating to simultaneously increase the size of the other, said motor also including means for moving said reciprocating means through a hydraulic power stroke and an expansion power stroke, said moving means including first means for selectively placing a source of said liquid and said first portion of said main chamber in fluid communication with one another and placing said second portion of said main chamber in fluid communication with a drain, said moving means further including second means for selectively placing said first and second portions of said main chamber in fluid communication with one another to form a single motor chamber, said motor further including means for controlling said first and second selectively placing means and means for transferring energy from said reciprocating means to a use device, said method comprising the steps of:

switching with said controlling means said first placing means so that said source of pressurized, saturated or near saturated liquid and said first portion of said main chamber are in fluid communication with one another and said second portion of said main chamber is in fluid communication with said drain wherein said reciprocating means moves through a hydraulic power stroke;

switching with said controlling means said second placing means so that said first and second portions of said main chamber are in fluid communication with one another wherein said liquid partially changes phase and expands to force said reciprocating means through an expansion power stroke.

* * * * *

UNITED STATES PATENT AND TRADEMARK OFFICE

CERTIFICATE OF CORRECTION

PATENT NO. : 4,945,725

DATED : August 7, 1990

INVENTOR(S) : David E. E. Carmein and Richard D. Hembree

It is certified that error appears in the above-identified patent and that said Letters Patent is hereby corrected as shown below:

Column 1, line 8, delete "Background of the Invention".

Column 1, line 10, delete "1." before the word "Field".

Column 1, line 17, "2. Description of the Prior Art" should be--Background of the Invention--.

Title page Item [54] "DIFFERENTIAL-AREA PISTON TYPE MIXED-PHASE MOTORS" should be--MIXED-PHASE MOTOR--.

Signed and Sealed this

Thirty-first Day of March, 1992

*Attest:*

HARRY F. MANBECK, JR.

*Attesting Officer*

*Commissioner of Patents and Trademarks*